US007462136B2

(12) United States Patent
Pan et al.

(10) Patent No.: US 7,462,136 B2
(45) Date of Patent: Dec. 9, 2008

(54) ELLIPTIC MOTION EXERCISE MACHINE

(75) Inventors: Francis Pan, Taichung County (TW); Pao-Chuan Wang, Taichung County (TW)

(73) Assignee: Forhouse Corporation, Daya Township (TW)

( * ) Notice: Subject to any disclaimer, the term of this patent is extended or adjusted under 35 U.S.C. 154(b) by 0 days.

(21) Appl. No.: 11/497,432

(22) Filed: Aug. 2, 2006

(65) Prior Publication Data

US 2008/0032868 A1 Feb. 7, 2008

(51) Int. Cl.
*A63B 69/16* (2006.01)
*A63B 22/04* (2006.01)

(52) U.S. Cl. ..... 482/52; 482/57; 482/51

(58) Field of Classification Search ..... 482/51–53, 482/57, 70, 79–80
See application file for complete search history.

(56) References Cited

U.S. PATENT DOCUMENTS 5,242,343 A 9/1993 Miller
5,800,315 A * 9/1998 Yu et al. ..... 482/57
5,865,712 A * 2/1999 Chang ..... 482/57
5,957,814 A * 9/1999 Eschenbach ..... 482/51
6,176,814 B1 * 1/2001 Ryan et al. ..... 482/51
6,277,056 B1 * 8/2001 McBride et al. ..... 482/57
6,482,132 B2 * 11/2002 Eschenbach ..... 482/52
6,612,969 B2 * 9/2003 Eschenbach ..... 482/51
6,966,869 B1 * 11/2005 Stearns et al. ..... 482/52
7,022,049 B2 * 4/2006 Ryan et al. ..... 482/51
7,025,711 B2 * 4/2006 Eschenbach ..... 482/52
7,270,626 B2 * 9/2007 Porth ..... 482/52

* cited by examiner

*Primary Examiner*—Stephen R. Crow
(74) *Attorney, Agent, or Firm*—Birch, Stewart, Kolasch & Birch, LLP

(57) ABSTRACT

An elliptic motion exercise machine includes a frame, on which a reciprocating motion mechanism, a circular motion mechanism and two linking members are provided. Two parallelogram linkage mechanisms are movably mounted on the frame and connected to the linking members. Two foot panels are fixed on the parallelogram linkage mechanisms respectively. The parallelogram linkage mechanisms keep the foot panels in fixed slops in the entire motion, such that when an user stands feet on the foot panels and exerts the foot panels, toes of user's feet moves in a speed that is substantially identical to that of use's heels.

10 Claims, 10 Drawing Sheets

ELLIPTIC MOTION EXERCISE MACHINE

BACKGROUND OF THE INVENTION

1. Field of the Invention

The present invention relates generally to an exercise machine, and more particularly to an elliptic motion exercise machine. In the path of motion, user's toe and heel have the same speed.

2. Description of the Related Art

Exercise machines provide various paths of motion that user may exercise various portions muscles thereon. For example, stepper provides vertical reciprocating motion, bike provides circular motion, air walker provides horizontal reciprocating motion, and elliptical trainer provides elliptical motion.

U.S. Pat. No. 5,242,343, issued to Miller, disclosed an elliptical trainer, which includes a frame, on which a rotational motion mechanism, a reciprocating motion mechanism and a pair of foot engaging links connected to the rotational motion mechanism and the reciprocating motion mechanism are provided. The rotational motion mechanism generates a circular motion, and the reciprocating motion mechanism generates a linear or curved reciprocating motion. User stands on the foot engaging links may exercise along an elliptic motion. When user takes exercise on Miller's trainer, the speeds of user's heels are greater than that of toes.

SUMMARY OF THE INVENTION

The primary objective of the present invention is to provide a exercise machine, when user take exercise on it, the speeds of user's heels are substantially identical to that of toes.

According to the objective of the present invention, an elliptic motion exercise machine includes a frame, on which a reciprocating motion mechanism, a circular motion mechanism and two linking members are provided. Two foot panels are provided to be moved by the linking members. The present invention provides means for keeping the foot panels in fixed slops in the entire motion, such that when an user stands feet on the foot panels and exerts the foot panels, toes of user's feet moves in a speed that is substantially identical to that of user's heels.

DETAILED DESCRIPTION OF THE INVENTION

Figure 1:
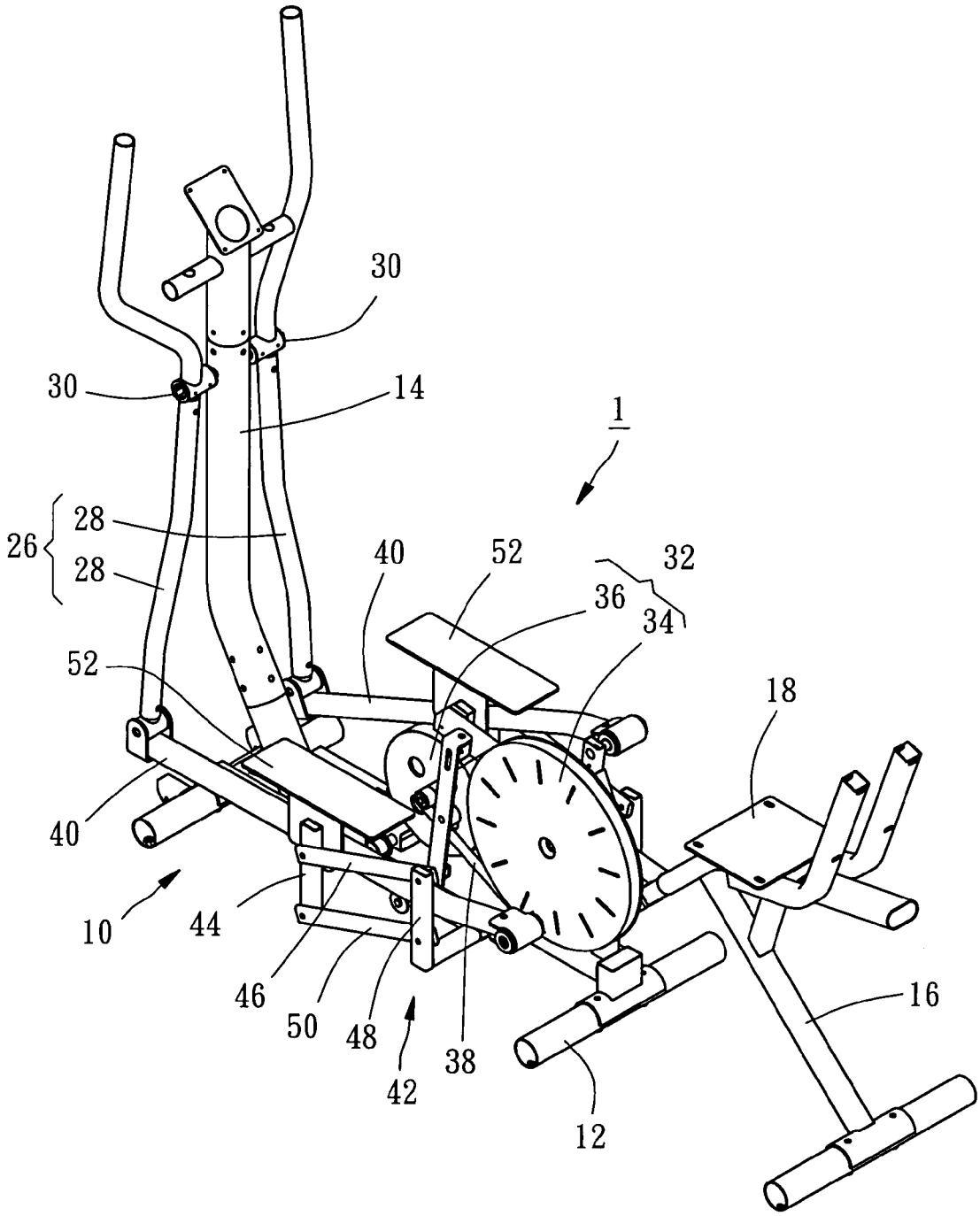
FIG. 1 and FIG. 2 are perspective views of a first preferred embodiment of the present invention.
Figure 2:
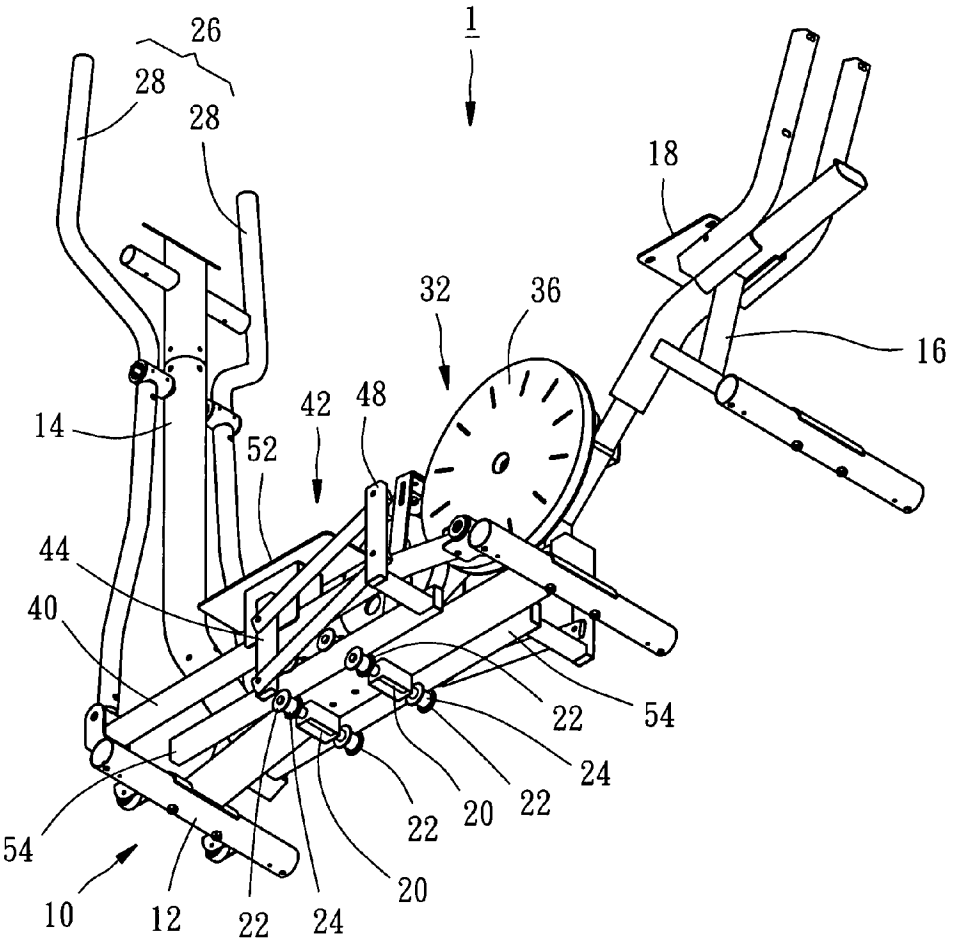

As shown in FIG. 1 and FIG. 2, an elliptic motion exercise machine 1 of the first preferred embodiment of the present invention mainly includes a frame 10, a reciprocating motion mechanism 26, a circular motion mechanism 32, two linking members 40, two parallelogram linkage mechanisms 42 and an extension frame 16.

The frame 10 has a base 12 and an upright shaft 14 fixed on a front side of the base 12. The extension frame 16 is fixed at a rear end of the base 12. The extension frame 16 has a seat 18. The base 12 is provided with two pairs of axles 20, each of which is pivoted with a roller 22 on opposite ends respectively. Each of the rollers 22 has a slot 24 on a circumference thereof.

The reciprocating motion mechanism 26 includes two handles 28 with a middle portion pivoted on the upright shaft 14 of the frame 10, by which user may hold the up sections of the handles 28, and the bottom ends of the handles 28 may generates curved reciprocating motions.

The circular motion mechanism 32 includes a wheel 34 and a flywheel 36 pivoted on the base 12 of the frame 10. A belt 38 connects the flywheel 36 and the wheel 34.

The linking members 40 have opposite ends pivoted on the bottom ends of the handle 28 of the reciprocating motion mechanism 26 and opposite sides of the wheel 34 of the circular motion mechanism 32. The linking members 40 move along an elliptic path under the co-action of the reciprocating motion mechanism 26 and the circular motion mechanism 32 like Miller's invention.

Each of the parallelogram linkage mechanisms 42 includes a first linkage 44, a second linkage 46, a third linkage 48 and a fourth linkage 50, wherein the first linkage 44 is parallel to the third linkage 48, and the second linkage 46 is parallel to the fourth linkage 50. The second and fourth linkages 46, 50 have opposite ends pivoted on the first and third linkages 44, 48 respectively to form a four-linkage mechanism. A foot panel 52 is provided on each of the first linkage 44. The first linkages 44 are pivoted on the linking members 40 respectively. Two guiding shafts 54 are connected to the third linkages 48 and received in the slots 24 of the rollers 22 respectively, such that the parallelogram linkage mechanisms 42 may reciprocate relative to the base 12 of the frame 10.

Figure 3:
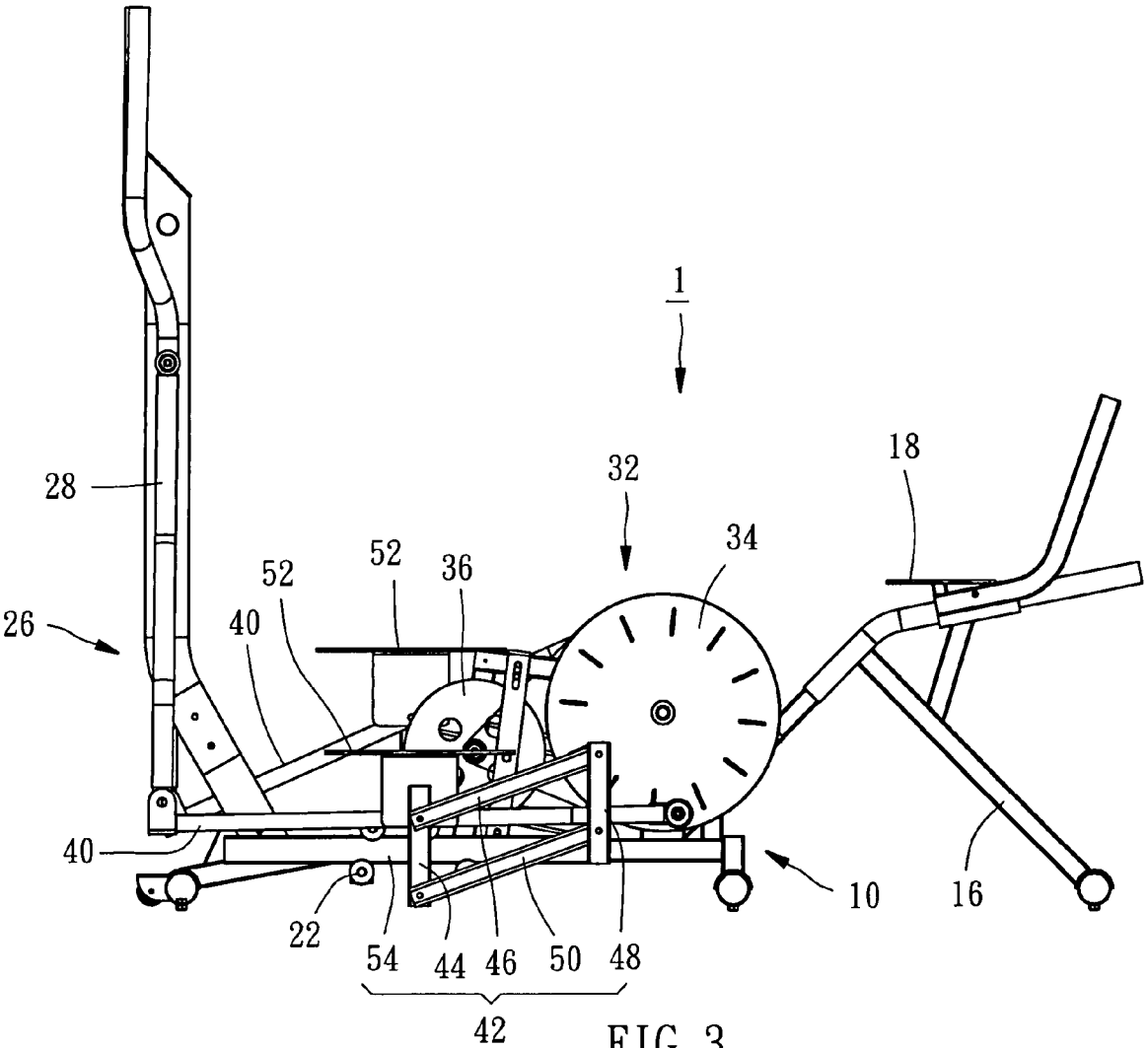
FIG. 3 and FIG. 4 are front views of the first preferred embodiment of the present invention, showing the action of the parallelogram linkage mechanism.
Figure 4:
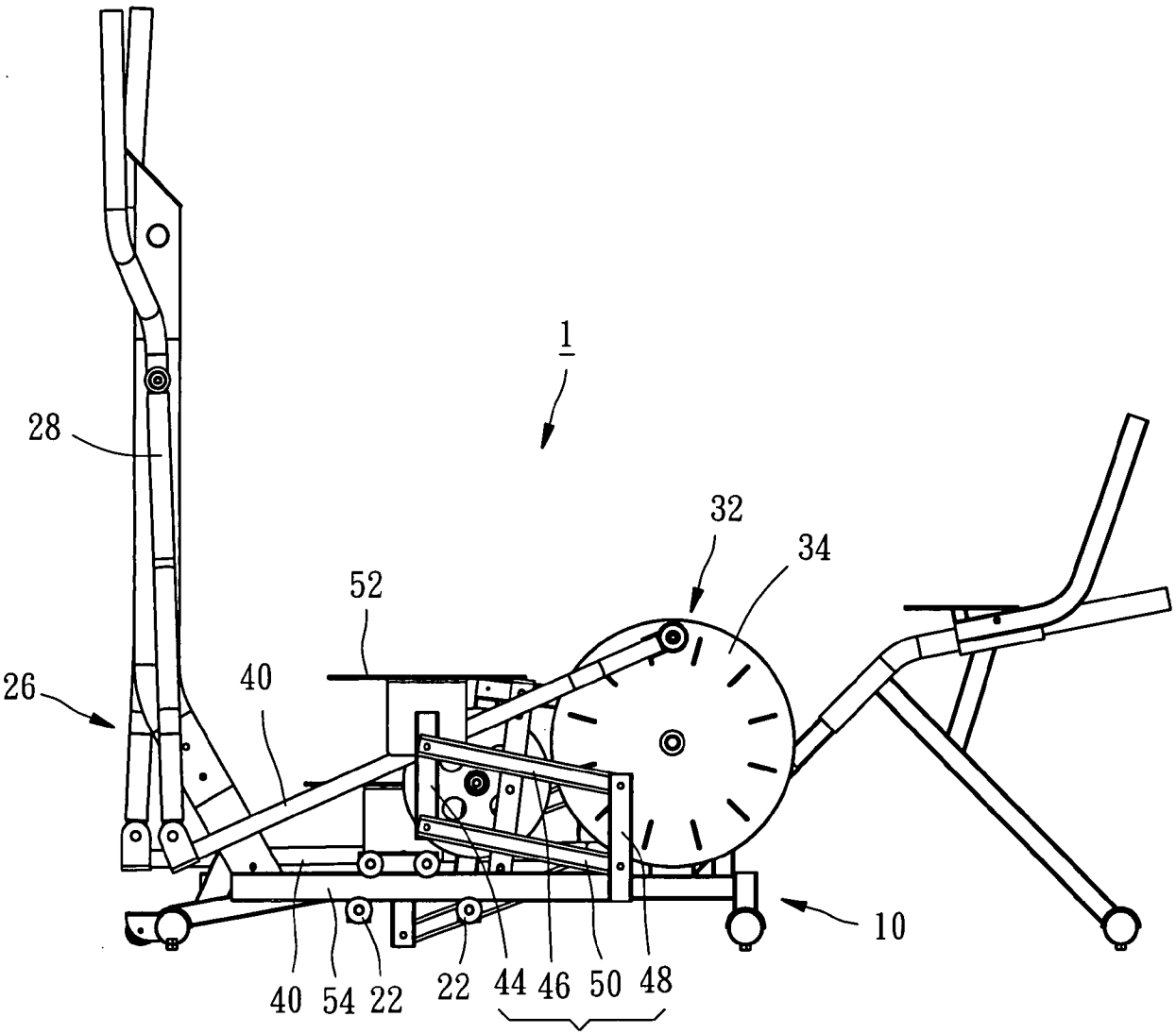
Figure 5:
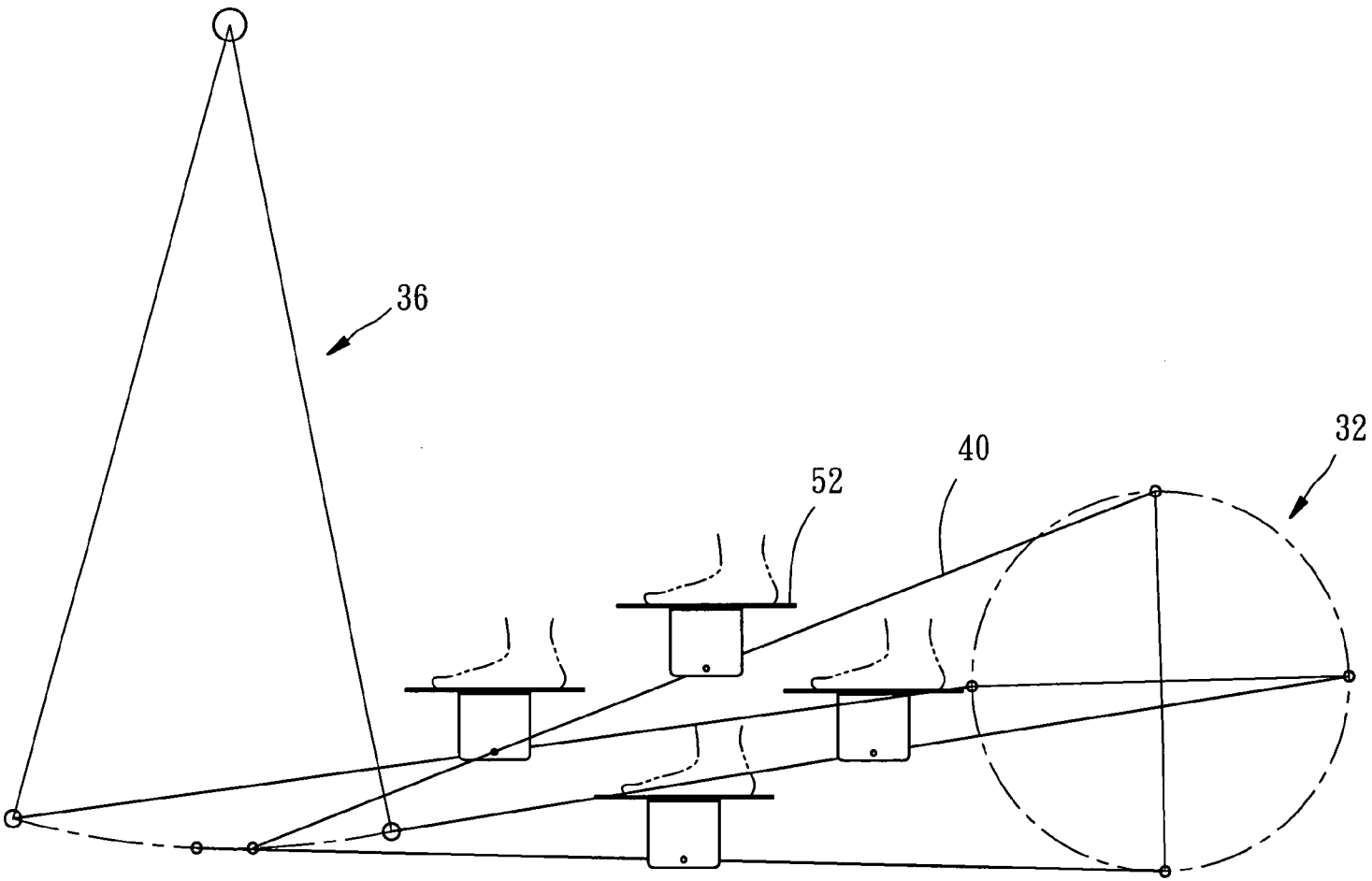
FIG. 5 is a sketch diagram of the first preferred embodiment of the present invention, showing the condition of user's foot in the path of motion.
Figure 6:
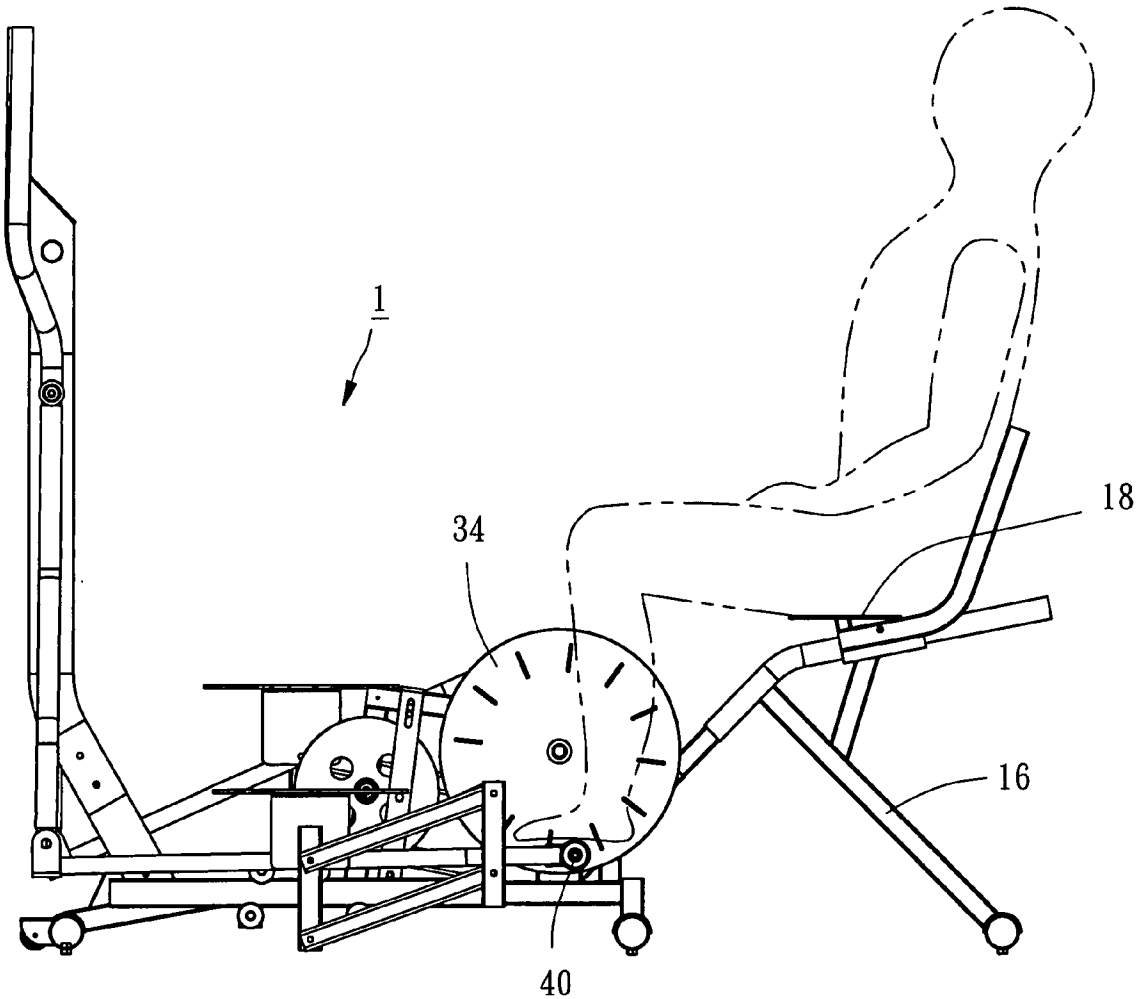
FIG. 6 is a front view of the first preferred embodiment of the present invention, showing user sitting on the extension frame.

As shown in FIG. 3 and FIG. 4, when user stands on the foot panels 52 and exerts, the feet move along an elliptic path under the co-action of the reciprocating motion mechanism 26, the circular motion mechanism 32 and the linking members 40. The parallelogram linkage mechanisms 42 move in a horizontal direction, and the first linkages 44 moves up-and-down along with the linking members 40. No matter what motion of the parallelogram linkage mechanisms 42, the first linkages 44 will be always parallel to the third linkages 48. In our invention, the third linkages 48 only move horizontally without any angle change. As a result, the slopes of the foot panels 52 do not change at all, and user's feet stood on the foot panels 52 have speeds of toes substantially identical to that of heels in the entire motion.

In addition, user may sit on the seat 18 of the extension frame 16 and step on the ends of the linking members 40 pivoted on the wheel 34 of the circular motion mechanism 32 to exercise like ride a bike.

Figure 7:
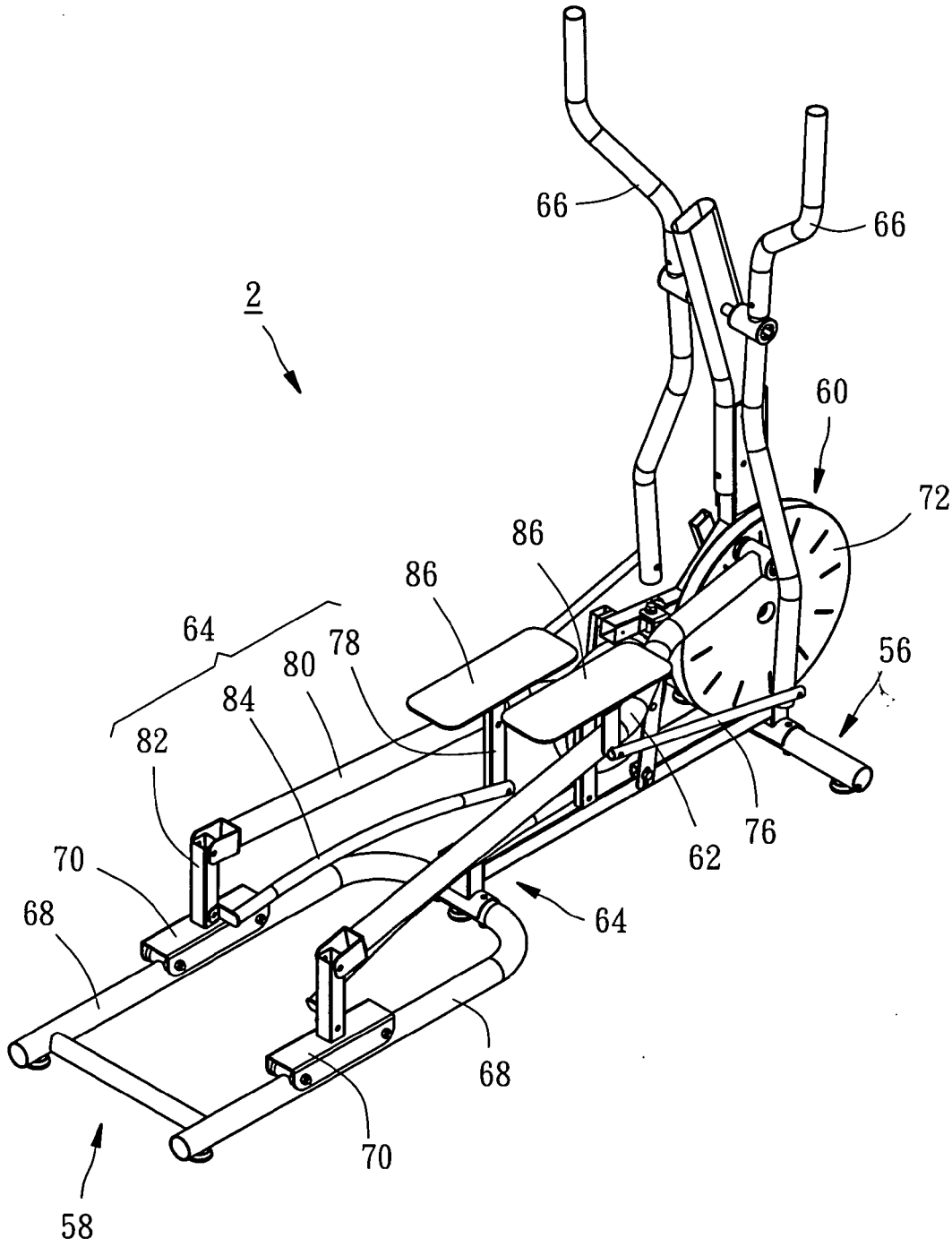
FIG. 7 is a perspective view of a second preferred embodiment of the present invention.

As shown in FIG. 7, an exercise machine 2 of the second preferred embodiment of the present invention includes a frame 56, a reciprocating motion mechanism 58, a circular motion mechanism 60, two linking members 62, two parallelogram linkage mechanisms 64 and two handles 66.

The reciprocating motion mechanism 58 includes two rails 68 at a rear of the frame 56 and two sliding members 70 reciprocating on the rails 68. The circular motion mechanism 60 includes a wheel 72 and a flywheel 74. The linking members 62 have opposite ends pivoted on opposite sides of the wheel 72 of the circular motion mechanism 60 and the sliding members 70 of the reciprocating motion mechanism 58. The handles 66 are pivoted on the frame 58 and connected to the linking members 62 through two bars 76, such that the linking members 62 will take the handles 66 moving along with them.

Each of the parallelogram linkage mechanisms 64 includes a first linkage 78, a second linkage 80, a third linkage 82 and a fourth linkage 84 to form a four-linkage mechanism. The second linkage 80 is a section of the linking member 62, such that the first linkage 78 is pivoted both of the linking member 62 and the second linkage 80. The third linkage 82 is projected from the sliding member 70, on a top of which the second linkage 80 (the linking member 62) is pivoted. The fourth linkage 84, under the second linkage 80, has opposite ends pivoted on a bottom of the third linkage 82 and the first linkage 78 respectively. A foot panel 86 is fixed on a top of the first linkage 78.

Figure 8:
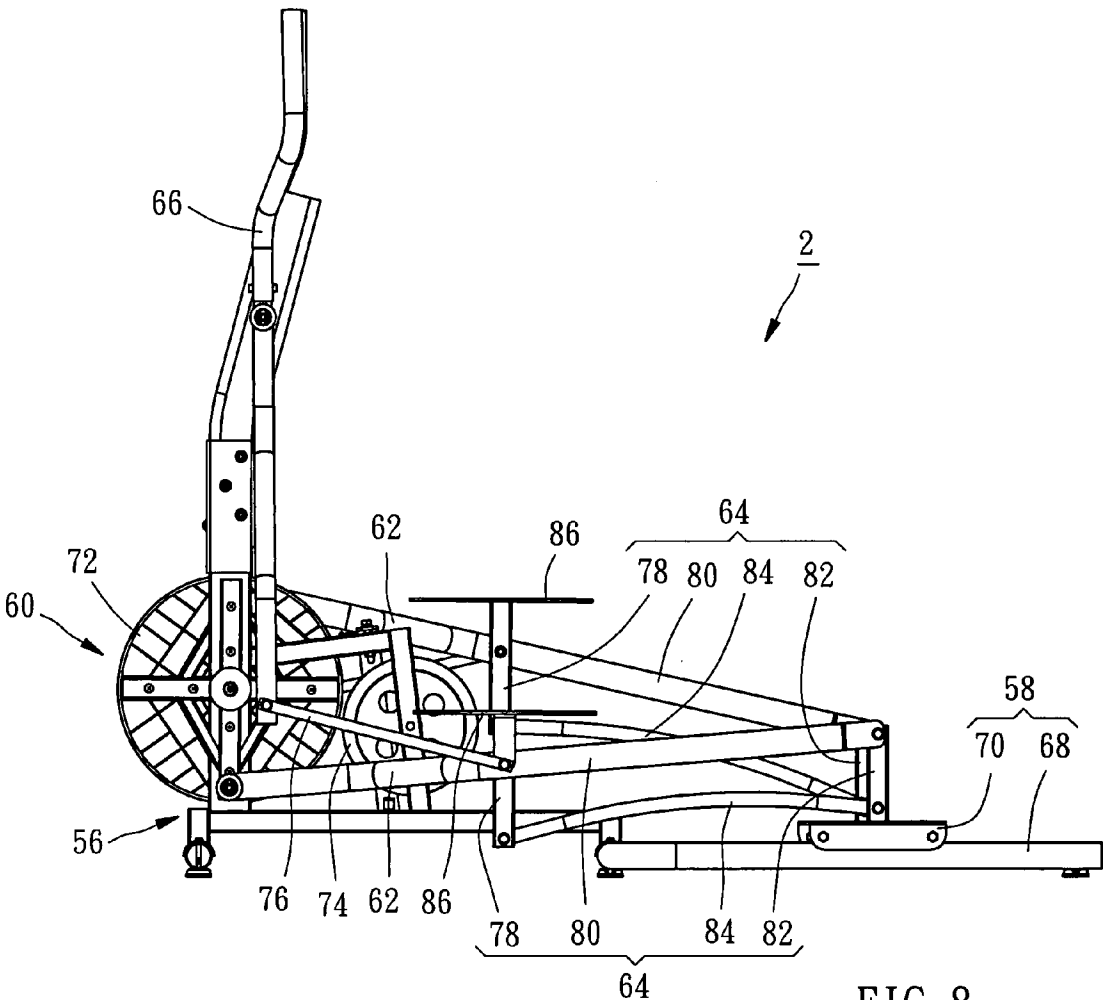
FIG. 8 and FIG. 9 are front views of the second preferred embodiment of the present invention, showing the action of the parallelogram linkage mechanism.
Figure 9:
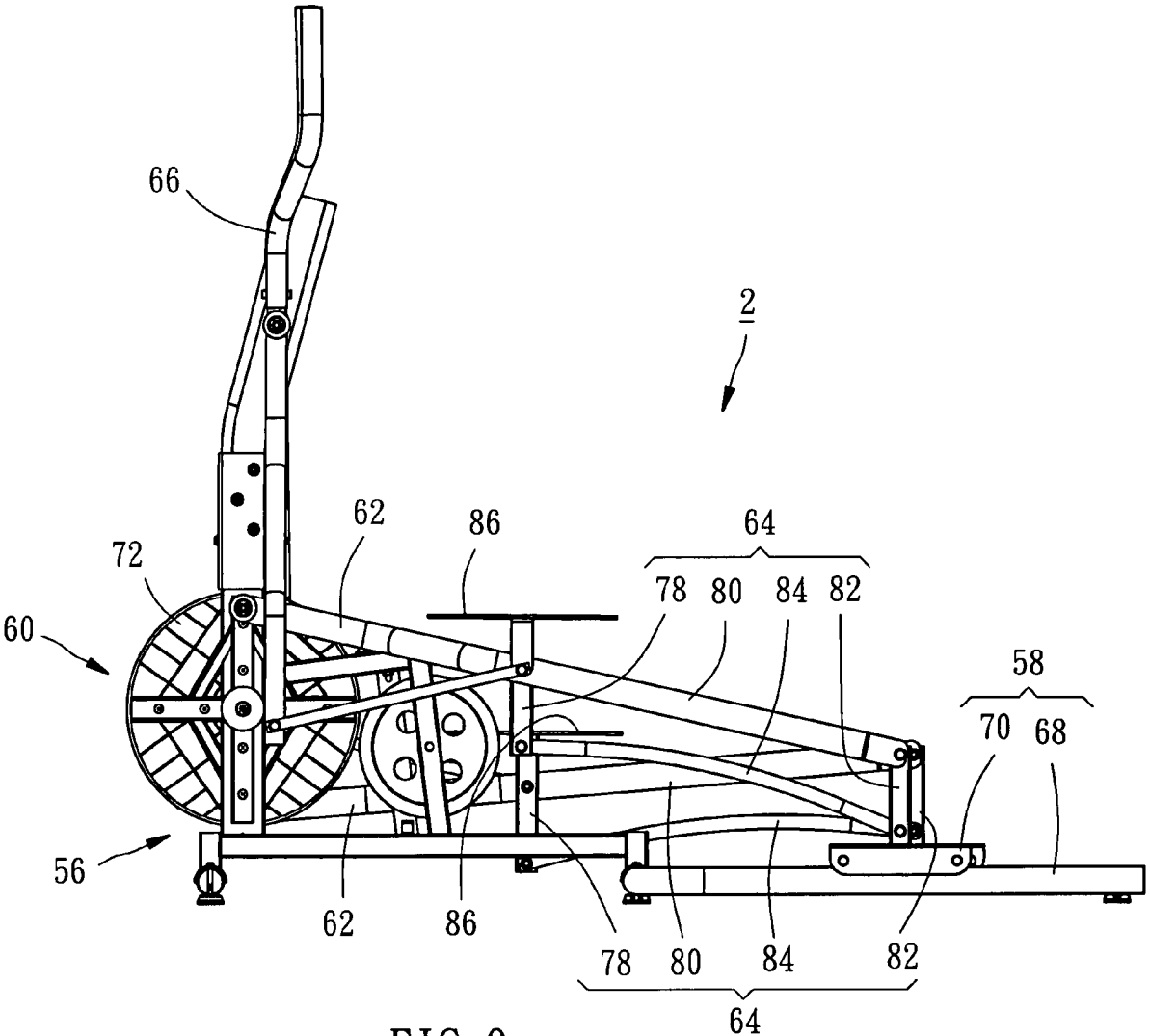
Figure 10:
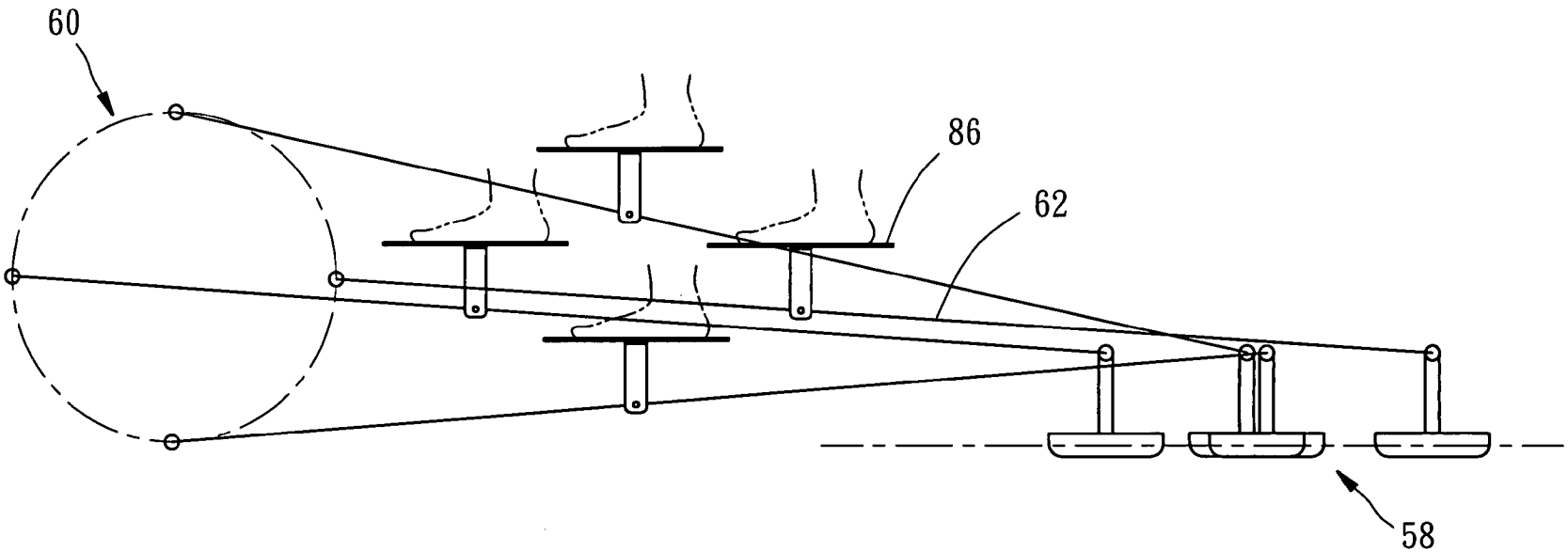
FIG. 10 is a sketch diagram of the second preferred embodiment of the present invention, showing the condition of user's foot in the path of motion.

With the same principle, as shown in FIG. 8 and FIG. 9, when a user stands the feet on the foot panels 86 and exerts, the feet move along an elliptic path, and the parallelogram linkage mechanisms 64 keep the foot panels 86 in a fixed slops in the entire elliptic motion, as shown in FIG. 10. As a result, toes of user's feet have a speed substantially as same as that of heels in the entire motion.

It is noted that the drawings of the present invention show that the foot panels have horizontal tops. It also may make the foot panels with a predetermined slope that may be made by making the foot panels with sloping top or leaning the first or third linkages of the parallelogram linkage mechanisms. No matter what angle the foot panels have, use's toes move in a speed substantially identical to that of hells.

What is claimed is:

1. An exercise machine, comprising:

a frame;

a reciprocating motion mechanism provided on the frame to provide a reciprocating motion;

a circular motion mechanism provided on the frame to provide a circular motion;

two linking members having opposite ends pivoted on the reciprocating motion mechanism and the circular motion mechanism;

two parallelogram linkage mechanisms, each of which has a first linkage, a second linkage, a third linkage and a fourth linkage, wherein the first linkage is substantially parallel to the third linkage, and the second linkage is substantially parallel to the fourth linkage, and the second linkage and the fourth linkage have opposite ends pivoted on the first linkage and the third linkage respectively to form a four-linkage mechanism;

the parallelogram linkage mechanisms movably mounted on the frame for reciprocation, and the first linkages pivoted on the linking members respectively;

two foot panels provided on the first linkages of the parallelogram linkage mechanisms respectively;

whereby when an user stands with feet on the foot panels and exerts the foot panels, the feet move along a substantially elliptic path, and user's toes move in a speed that is substantially identical to that of user's heels.

2. The exercise machine as defined in claim 1, wherein the frame is provided with slots, and each of the parallelogram linkage mechanisms has a guiding shaft connected to the third linkage and received in the slots to guide the parallelogram linkage mechanisms moving along the slots.

3. The exercise machine as defined in claim 1, wherein the frame is provided with rollers, and each of the parallelogram linkage mechanisms has a guiding shaft connected to the third linkage and received between the rollers to guide the parallelogram linkage mechanisms.

4. The exercise machine as defined in claim 3, wherein each of the rollers has a slot, in which the guiding shaft is received.

5. The exercise machine as defined in claim 1, further comprising an extension frame fixed to the frame, on which a seat is provided beside the circular motion mechanism.

6. The exercise machine as defined in claim 1, wherein the reciprocating motion mechanism has two handles with middle portions pivoted on the frame, and the linking member are pivoted on the ends of the handles respectively.

7. The exercise machine as defined in claim 1, wherein the reciprocating motion mechanism has two rails and two sliding members reciprocating on the rails, and the linking members are pivoted on the sliding members.

8. The exercise machine as defined in claim 1, wherein the circular motion mechanism has a wheel, on opposite ends of which the linking members are pivoted, a flywheel and a belt connecting the wheel and the flywheel.

9. The exercise machine as defined in claim 1, wherein the second linkage of the parallelogram linkage mechanism is a section of the linking member, such that the first linkage is pivoted on the linking member as well as on the second linkage, and the third linkage is connected to the reciprocating motion mechanism, such that the parallelogram linkage mechanism moves along with the reciprocating motion mechanism.

10. The exercise machine as defined in claim 1, further comprising two handles pivoted on the frame, and two bars linking the handles and the linking members respectively, such that the linking members drive the handles.

* * * * *